US007101077B2

(12) United States Patent
Esteve et al.

(10) Patent No.: US 7,101,077 B2
(45) Date of Patent: Sep. 5, 2006

(54) DEVICE FOR FAST VIBRATION OF TUBES CONTAINING SAMPLES

(75) Inventors: Alain Esteve, Le Vesinet (FR); Jean Boquet, Le Perray en Yvelines (FR)

(73) Assignee: Bertin Technologies S.A., Montigny le Bretonneau (FR)

( * ) Notice: Subject to any disclaimer, the term of this patent is extended or adjusted under 35 U.S.C. 154(b) by 0 days.

(21) Appl. No.: 11/044,549

(22) Filed: Jan. 27, 2005

(65) Prior Publication Data

US 2005/0128863 A1 Jun. 16, 2005

Related U.S. Application Data

(63) Continuation of application No. PCT/FR03/02253, filed on Jul. 16, 2003.

(30) Foreign Application Priority Data

Aug. 1, 2002 (FR) ..... 02 09832
Feb. 25, 2003 (FR) ..... 03 02308

(51) Int. Cl.
*B01F 11/00* (2006.01)

(52) U.S. Cl. ..... 366/110; 366/209

(58) Field of Classification Search ..... 366/110–114, 366/208–219

See application file for complete search history.

(56) References Cited

U.S. PATENT DOCUMENTS 760,664 A * 5/1904 Van Der Valk ..... 366/216
2,552,188 A * 5/1951 Krause et al. ..... 366/215
3,985,307 A * 10/1976 Ebbert et al. ..... 366/602
4,125,335 A 11/1978 Blume et al.
4,702,610 A * 10/1987 Reynolds, Jr. ..... 366/213
5,024,114 A 6/1991 Guttinger
5,567,050 A 10/1996 Zlobinsky et al.
5,624,185 A * 4/1997 Whisson ..... 366/208
5,639,160 A 6/1997 Kishimoto
5,921,676 A * 7/1999 Reynolds et al. ..... 366/208
6,190,032 B1 * 2/2001 Choda ..... 366/208
6,235,501 B1 5/2001 Gautsch et al.
2004/0151064 A1 * 8/2004 Yi ..... 366/209
2005/0128863 A1 * 6/2005 Esteve et al. ..... 366/110

FOREIGN PATENT DOCUMENTS

DE 34 37 804 A 7/1985
FR 2839267 * 11/2003
JP 05 284961 A 11/1993
JP 8-173784 * 7/1996

* cited by examiner

*Primary Examiner*—Charles E. Cooley
(74) *Attorney, Agent, or Firm*—Alston & Bird LLP

(57) ABSTRACT

Apparatus for rapidly vibrating tubes containing samples, e.g. biological samples, comprises a tube-support disk and concentric bearings for mounting the disk in a ring that is resiliently-suspended from a frame, the bearings comprising two rolling bearings mounted one within the other. The invention enables the tubes containing samples to be subjected to curvilinear reciprocating motion at high frequency.

18 Claims, 5 Drawing Sheets

DEVICE FOR FAST VIBRATION OF TUBES CONTAINING SAMPLES

CROSS-REFERENCE TO RELATED APPLICATIONS

This application is a continuation of PCT/FR03/02253, filed Jul. 16, 2003, claiming priority from French Application Nos. 02 09832, filed Aug. 1, 2002 and 03 02308, filed Feb. 25, 2003 which are hereby incorporated herein in its entirety by reference.

BACKGROUND OF THE INVENTION

The invention relates to apparatus for rapidly vibrating tubes containing samples, in particular biological samples, the rapid vibration of the tubes serving to grind up the samples.

It is already known to grind up biological samples by enclosing the samples in tubes that also contain microbeads made of glass or ceramic, and by subjecting the tubes that are closed in leaktight manner to axial vibration at high speed, e.g. at about 100 hertz (Hz), for a relatively short duration, of the order of 30 seconds (s) to 60 s, for example.

U.S. Pat. No. 5,567,050 describes apparatus for performing such a method and comprising a tube support disk and means for imparting oscillating motion to the disk about a center of rotation. The drive means comprise an electric motor whose outlet shaft is provided with a sleeve having an outside cylindrical surface that slopes obliquely relative to the axis of the outlet shaft of the motor. The sleeve is mounted free to rotate in the disk by means of rolling bearings in axial alignment, and the disk is associated with means for preventing it from rotating, so that when the sleeve is rotated by the motor, it causes the disk to oscillate about a center of rotation which is formed by the intersection between the axis of the motor shaft and the axis of the cylindrical outside surface of the sleeve. Tubes fixed at the periphery of the disk at equal distances from the center of rotation are thus subjected to substantially curvilinear reciprocating motion. In theory, the speed of rotation of the outlet shaft from the motor can lie in the range 3000 revolutions per minute (rpm) to 8000 rpm, and the samples are subjected to linear accelerations lying in the range 150 g to 400 g in order to be ground up, where g is the acceleration due to gravity.

Nevertheless, that known apparatus presents the drawback of the rolling bearings that serve to mount the disk on the sleeve and that support all of the forces for driving the disk, heat up rapidly, thereby causing the rolling bearings to wear quickly and very significantly reducing their lifetime, with the heating-up of the rolling bearings also leading to heating of the disk, which heat is then transmitted to the tubes and to the samples contained in the tubes. In practice, with that type of apparatus, it is not possible to cause the disk to oscillate at a speed greater than about 6000 rpm without destroying the apparatus fairly quickly. In addition, the heating of the rolling bearings and of the disk make it necessary to pause for a certain length of time between two grinding cycles, so as to allow the disk and the rolling bearings to cool down sufficiently.

Furthermore, in that prior art apparatus, the tubes need to be handled one by one in order to be placed in the housings provided in the disk, and in order to be taken away therefrom, and it is also necessary to install and maneuver by hands means for locking the tubes in their housings in the disk, thereby greatly lengthening the times required for loading and unloading the apparatus, thereby correspondingly increasing the total durations of sample analysis cycles.

SUMMARY OF THE INVENTION

A particular object of the present invention is to provide a solution to this problem that is simple, effective, and inexpensive.

The invention provides an apparatus of the above-specified type for rapidly vibrating tubes containing samples for analysis, the apparatus having a lifetime that is much greater than that of presently-known competing apparatuses.

The invention also provides an apparatus of the above-specified type that can operate without damage at high oscillation frequencies, higher than those of presently-known competing apparatus.

The invention also provides an apparatus of that type which is simpler and less expensive and also easier and quicker to use than previously-known apparatuses.

To this end, the invention provides apparatus for rapidly vibrating tubes containing samples, in particular biological samples, the apparatus comprising a disk for supporting the tubes, means for preventing the disk from turning about its own axis, and means for driving the disk in oscillating motion about a center of rotation situated on the axis of the disk, wherein the disk is supported and centered on an elastically-suspended portion of the apparatus by means of two concentric bearings mounted one within the other, one of the bearings being of the spherical type enabling the disk to execute oscillating motion about the center of rotation.

The essential advantage of the apparatus of the invention is that the means for supporting and centering the disk do not need to withstand the forces due to drive being applied to the disk such that said means can be constituted by bearings, and in particular by rolling bearings, without them being damaged or destroyed quickly during operation of the apparatus.

Both bearings are preferably rolling bearings. The first of these bearings comprises a radially-inner cage secured to an axial cylindrical endpiece of the disk, and a radially-outer cage which is constrained to rotate with the radially-inner cage of the second bearing. The radially- outer cage of the second bearing is secured to the stationary portion of the apparatus.

The first bearing is a spherical rolling bearing which enables the disk to perform oscillating motion about the center of rotation. The second bearing is a rolling bearing whose inner cage turns at high speed with the outer cage of the first bearing, the inner cage of the first bearing and the outer cage of the second bearing being prevented from rotating, and the inner cage of the first bearing oscillating together with the disk relative to the outer cage of said first bearing.

At its free end, the cylindrical endpiece of the disk is connected via a third bearing, e.g. a spherical type rolling bearing, to an eccentric mounted at the end of a drive shaft.

In order to accommodate thermal expansion, either the endpiece is mounted to slide axially in the third bearing, or else the first bearing is mounted to slide axially inside the second.

According to other characteristics of the invention, the tubes are mounted in housings provided in baskets in the form of circular sectors that are positioned and secured in removable manner on the disk, and means are provided for holding the tubes in their housings, which means advantageously comprise a cover mounted on the disk in order to cover the tubes placed in their housings, and means for blocking or locking the cover in its tube-holding position.

In a preferred embodiment of the invention, the cover is held on the disk by suction in a position where it locks the tubes in their housings. To do this, the cover co-operates with the disk to define a leaktight chamber that is connected to a vacuum source.

In addition, snap-fastening locking means are provided on the disk to enable a cover to be angularly positioned and locked quickly and automatically in its position for holding the tubes in their housings.

Advantageously, the means for connecting the chamber to the vacuum source constitute means for preventing the disk from rotating.

In a first embodiment, the cover has radial fingers at its periphery, each radial finger bearing resiliently against a stopper for a tube in order to hold the tube in its housing in the disk.

In a variant embodiment, a ring has tube-receiving orifices at its periphery and enables the tubes to be loaded outside the apparatus. Thereafter, the ring carrying the tubes is placed on the disk and is covered by the above-mentioned cover, which is then secured and held in place by suction as described above.

In another variant, the above-mentioned ring has blind housings for receiving tubes and a ring of rubber or the like is placed on the tube-receiving ring in order to close its housings in leaktight manner when the cover is put into place thereon, itself being placed on the disk.

Thus, in the event of a tube being broken during vibration, overall contamination of the apparatus and its environment is avoided.

In a preferred embodiment of the invention, the concentric bearings of the disk are carried by a ring which is secured to a stationary frame by resilient suspension means.

The electric motor for driving the disk is secured to said frame, with its outlet shaft connected via a resilient coupling to a turntable carrying the eccentric third bearing for driving the cylindrical endpiece of the disk, said turntable being mounted in a rolling-bearing box carried by the frame.

This ensures decoupling between the motor, the turntable carrying the eccentric bearing, and the disk, thus avoiding any need to subject the motor to the vibration and stresses from the ring, the disk, and the turntable. This increases the lifetime of the motor and it is possible to cause the apparatus to run at full load with the motor at a higher speed of rotation.

BRIEF DESCRIPTION OF THE DRAWINGS

The invention will be better understood and other characteristics, details, and advantages thereof will appear more clearly on reading the following description given by way of example with reference to the accompanying drawings, in which.

DETAILED DESCRIPTION

Figure 1:
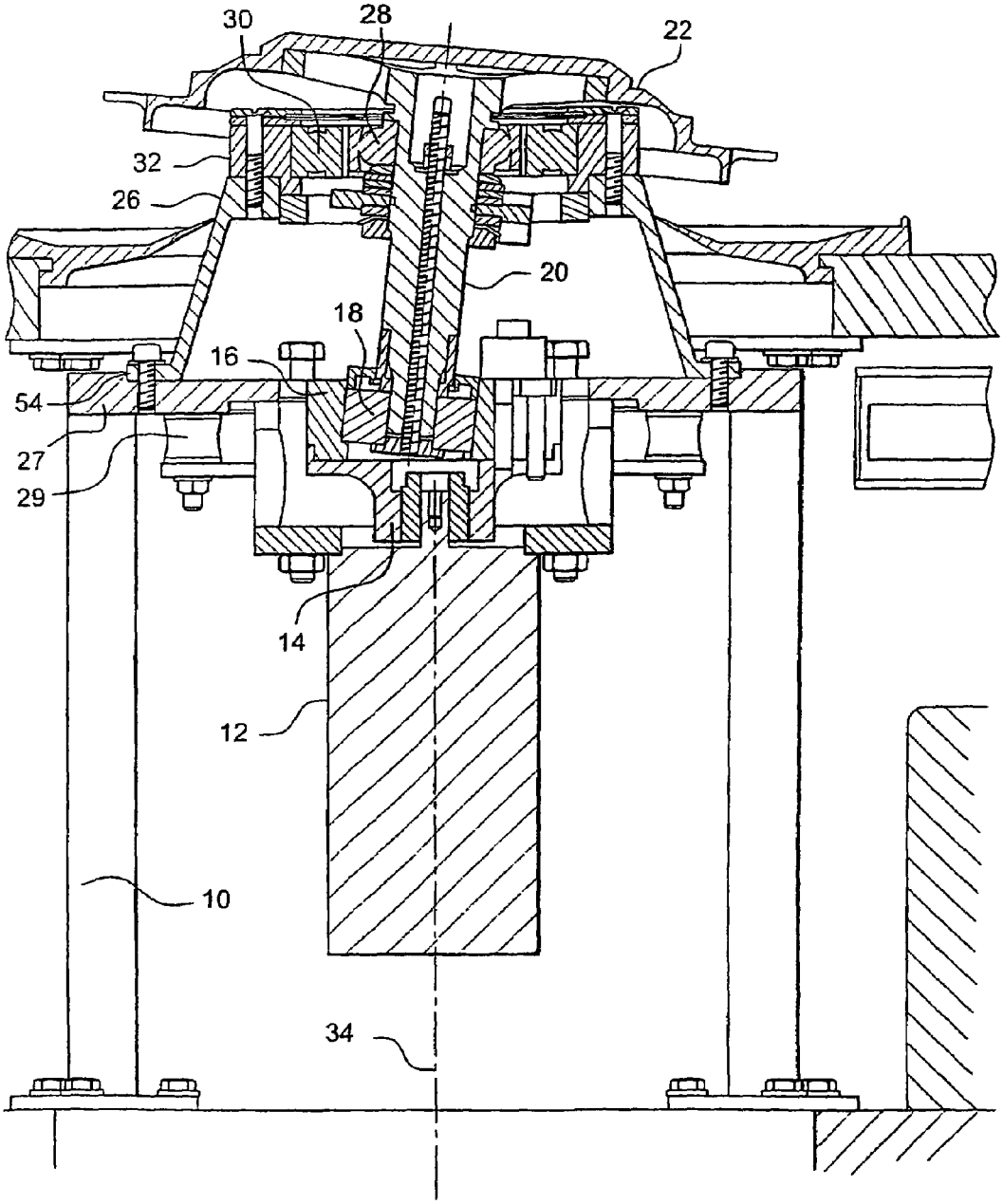
FIG. 1 is a diagrammatic axial section view of an embodiment of an apparatus of the invention, with the cover removed.
Figure 2:
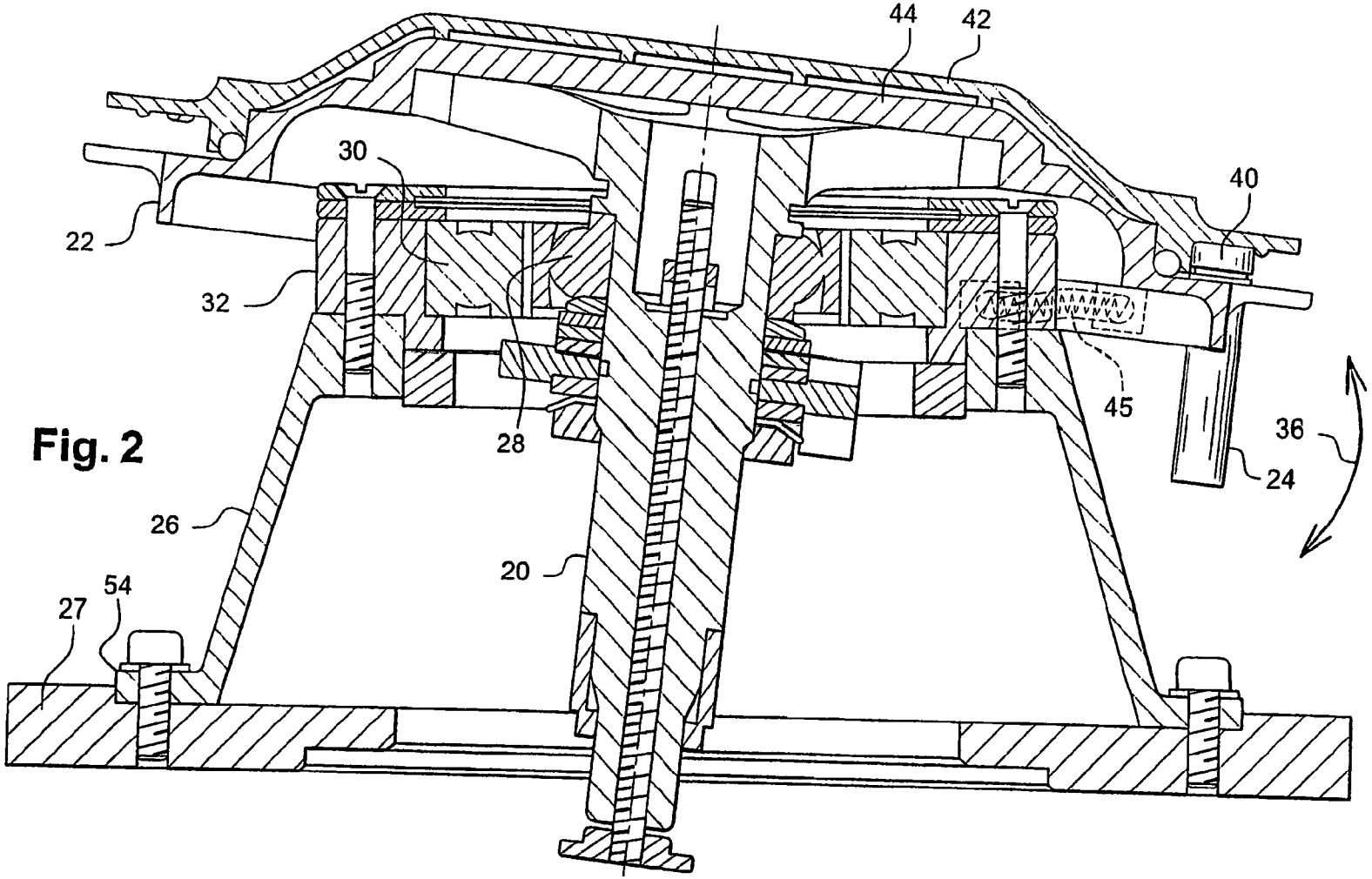
FIG. 2 is a diagrammatic axial section view of the disk of the FIG. 1 apparatus with its cover in place.

The embodiment shown in FIGS. 1 and 2 of the apparatus of the invention comprises a frame 10 with a bottom portion containing an electric motor 12 whose outlet shaft 14 extends vertically upwards and carries a turntable 16 having a rolling bearing 18 mounted obliquely and off-center. The bearing 18 receives the bottom end of a sloping shaft 20 formed by an endpiece that is axially cylindrical and projects from a disk 22 for supporting sample tubes 24, the disk 22 extending perpendicularly to the shaft 20 and being secured to the end thereof or being formed integrally with the shaft 20, as shown. The bearing 18 is inclined so as to be axially in alignment with the shaft 20, and it is preferably of the spherical type in order to accommodate small mechanical defects.

The disk 22 is supported and centered on a ring 26 carried by the frame 10, by means of two concentric bearings 28, 30 mounted one inside the other between the shaft 20 and the ring 26 and shown diagrammatically in FIGS. 1 and 2.

The first bearing 28 is a spherical type rolling bearing comprising a radially-inner cage secured to the shaft 20 and a radially-outer cage relative to which the inner cage can oscillate about a center of rotation situated on the axis of the shaft 20. The center of rotation is the center of oscillating movement of the disk 22 in the apparatus of the invention.

The outer cage of the bearing 28 is constrained to rotate with the inner cage of the second bearing 30, inside which it is mounted.

The outer cage of the second bearing 30 is secured to the inside of a band 32 which is screwed onto the ring 26. On its top surface, the band carries a washer covering the bearing 28 and 30, and separating them in leakproof manner from the top portion of the disk 22 which carries the tubes 24.

The ring 26 includes an outwardly-directed flange 54 secured by screws to a plate 27 mounted on the frame 10 via resilient suspension means 29. The motor 12 is secured to the plate 27.

Means are provided for preventing the disk from turning, e.g. comprising one or more springs radially connecting the ring 26 to the shaft 20.

Figure 3:
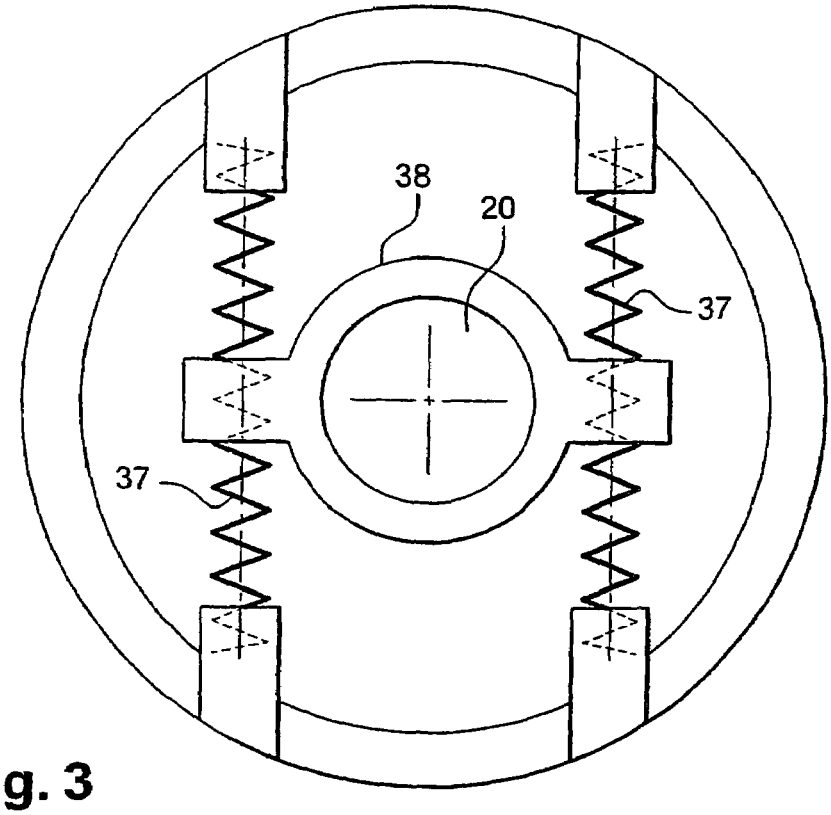
FIG. 3 shows means for preventing rotation.

In a particular embodiment shown diagrammatically in FIG. 3, these means comprise two parallel springs 37 mounted between the ring 26 and a washer 38 secured to the shaft 20. The middle portions and the ends of the springs are secured by screw-engagement in cylindrical tabs or sleeves of the ring 26 and of the washer 38 as shown. When the shaft 20 and the disk 22 tend to turn in one direction, that compresses two diametrically-opposite halves of the springs 37 while expanding the other two halves of the springs 37. These springs may be lightly prestressed in compression or in traction in the equilibrium position shown in the drawing.

The apparatus operates as follows:

When the motor 12 is powered, the turntable 16 is rotated about a vertical axis 34 and the sloping shaft 20 turns, traveling over a conical surface whose apex is at the intersection between the vertical axis 34 of rotation of the turntable 16 and the axis of the sloping shaft 20. The disk 22 is prevented from rotating about the axis of the sloping shaft 20 and the vertical axis 34, so it is then driven with oscillating motion about the center of rotation formed by the intersection between the axis 34 and the axis of the shaft 20, and the tubes 24 carried by the disk 22 are moved with curvilinear reciprocating motion as represented by arrow 36.

The outer cage of the first bearing 28 and the inner cage of the second bearing 30 which are fixed to each other are driven to rotate at high speed when the turntable 16 is rotated. This rotation of the cages involves only parts of low inertia and of almost no friction so it absorbs relatively little energy. Because of the rotation of these two cages, the rotary torque transmitted to the disk 22 is relatively low, and the disk can be prevented from rotating by means that are simple and light in weight.

The two bearings 28 and 30 of the apparatus present no signs of fatigue or wear when the turntable 16 is driven at speeds of rotation of about 6500 rpm for 60-second cycles that are repeated at intervals of a few minutes over durations of several days. The apparatus of the invention can be used at speeds of rotation of 8000 rpm, with the tubes being subjected to accelerations of about 600 g.

In addition, the stroke of the tubes 24 can be modified merely by changing the eccentricity of the bearing 18 or the diameter of the disk 22.

The sample-containing tubes 24 are closed by stoppers 40 that are held in place by means of a cover 42 of circular shape which is engaged on the top face of the disk 22. The cover 42 has radial fingers bearing resiliently against the stoppers 40 of the tubes 24 placed in their housings, which are formed by orifices in the periphery of the disk 22.

In addition, the cover 42 placed on the disk 22 co-operates therewith to define a leaktight chamber 44 which is connected to a vacuum source external to the apparatus by hoses 45 connecting the disk 22 to the ring 26 and which can advantageously form means for preventing the disk 22 from rotating. The hoses 45 are advantageously received inside coil springs so as to withstand the driving forces and frequencies and ensure that the disk 22 is prevented from rotating, as a replacement for the means 37, 38 described above.

Resilient snap-fastening fingers are also provided on the disk 22 extending upwards and passing through orifices in the cover 42 to enable the cover to be angularly positioned and locked quickly and automatically on the disk, these fingers being two in number and diametrically opposite, for example.

Figure 4:
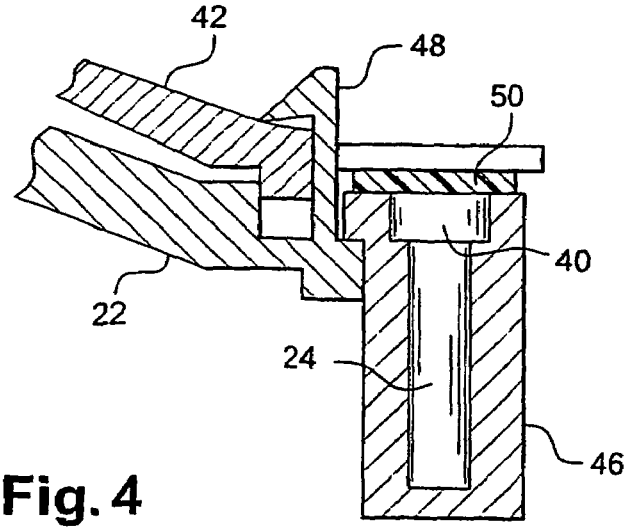
FIG. 4 is a diagrammatic fragmentary view of tube-receiver means.

A variant embodiment shown diagrammatically in FIG. 4 enables an operator to prepare the tubes 24 individually, to close them by means of the stoppers 4, and subsequently to place them in their housings in a removable ring 46 for mounting between the disk 22 and the cover 42.

Once the ring has received all of its tubes 24, it is loaded onto the disk 22 of the vibrator apparatus. The cover 42 is put into place and locked by snap-fastening on the fingers 48 of the disk, and it is held by the suction in the chamber 44, after which the motor 12 is powered to cause the disk 22 to oscillate abut the above-specified center of rotation.

At the end of a grinding cycle, when the motor 12 is stopped, the chamber 44 is connected to ambient pressure, the snap-fastening fingers are pushed back resiliently, the cover is removed, and the ring 46 is withdrawn from the disk 22 and is replaced by another ring carrying tubes 24 containing samples for grinding.

The apparatus of the invention can thus be loaded and unloaded simply and quickly.

Advantageously, the tube-receiving housings 24 in the ring 46 are blind, and an annular liner 50 of rubber or the like may be placed on the housings in order to close them individually in leaktight manner.

If a tube 24 should break during a vibration cycle, its content is retained in the corresponding housing of the basket by the rubber liner which closes the housing in leaktight manner. This avoids contaminating the apparatus and its environment as a whole.

Figure 5:
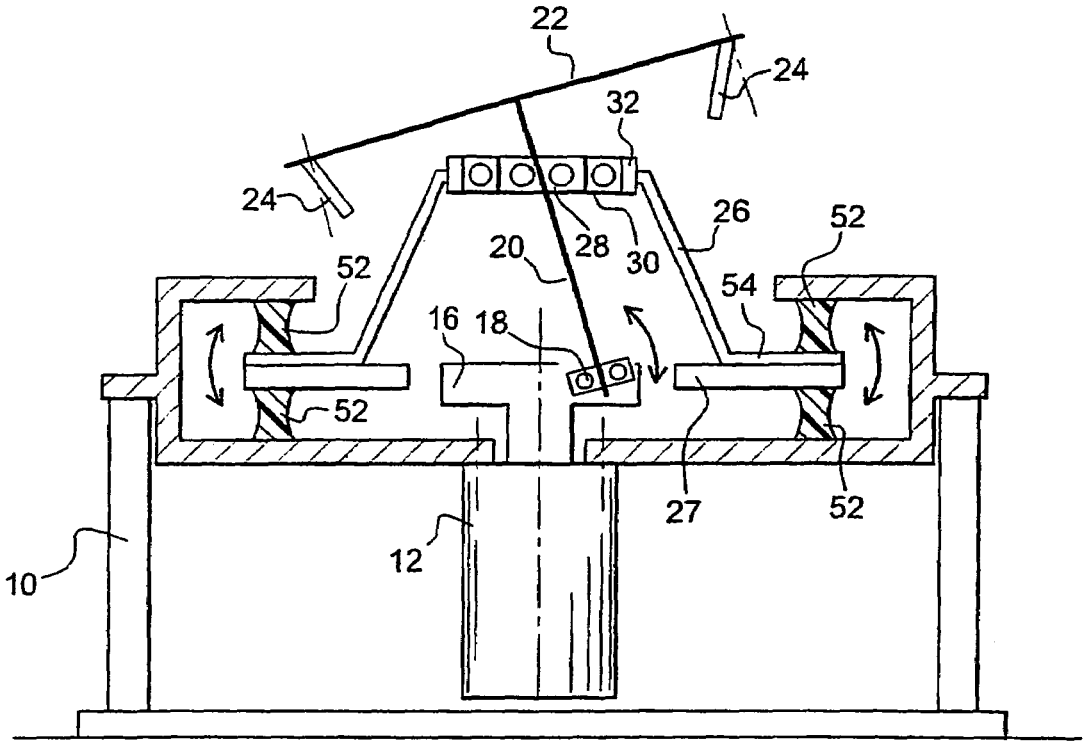
FIG. 5 is a diagrammatic section view of a variant embodiment of the invention.

In the preferred embodiment of the invention, as shown diagrammatically in FIG. 5, the electric motor 12 is secured by screws or the like directly to the frame 10 and the ring 26 is mounted on the frame 10 by resilient suspension means of conventional type, e.g. comprising studs 52 of rubber or the like interconnected in pairs to the frame 10 and to a peripheral flange 54 on the ring 26 that stands on the plate 27.

This kind of mounting prevents the vibration and the forces applied to the ring 26 being transmitted to the motor 12, thereby very significantly increasing the lifetime of the motor.

In addition, the invention provides for the sample tubes 24 being mounted on the disk 22 in a manner that is not parallel to its axis, but that is inclined towards said axis, the axes of the tubes 24 converging towards a point on the axis of the disk endpiece 20 that is situated beneath or above the disk.

The angle formed by the axes of the tubes 24 relative to the axis of the endpiece 20 is small, typically lying in the range 5° to 30° approximately, and preferably being about 10°.

In operation, the balls contained together with the samples in the inclined tubes 34 are displaced through the samples more effectively, thereby grinding them better.

Figure 6:
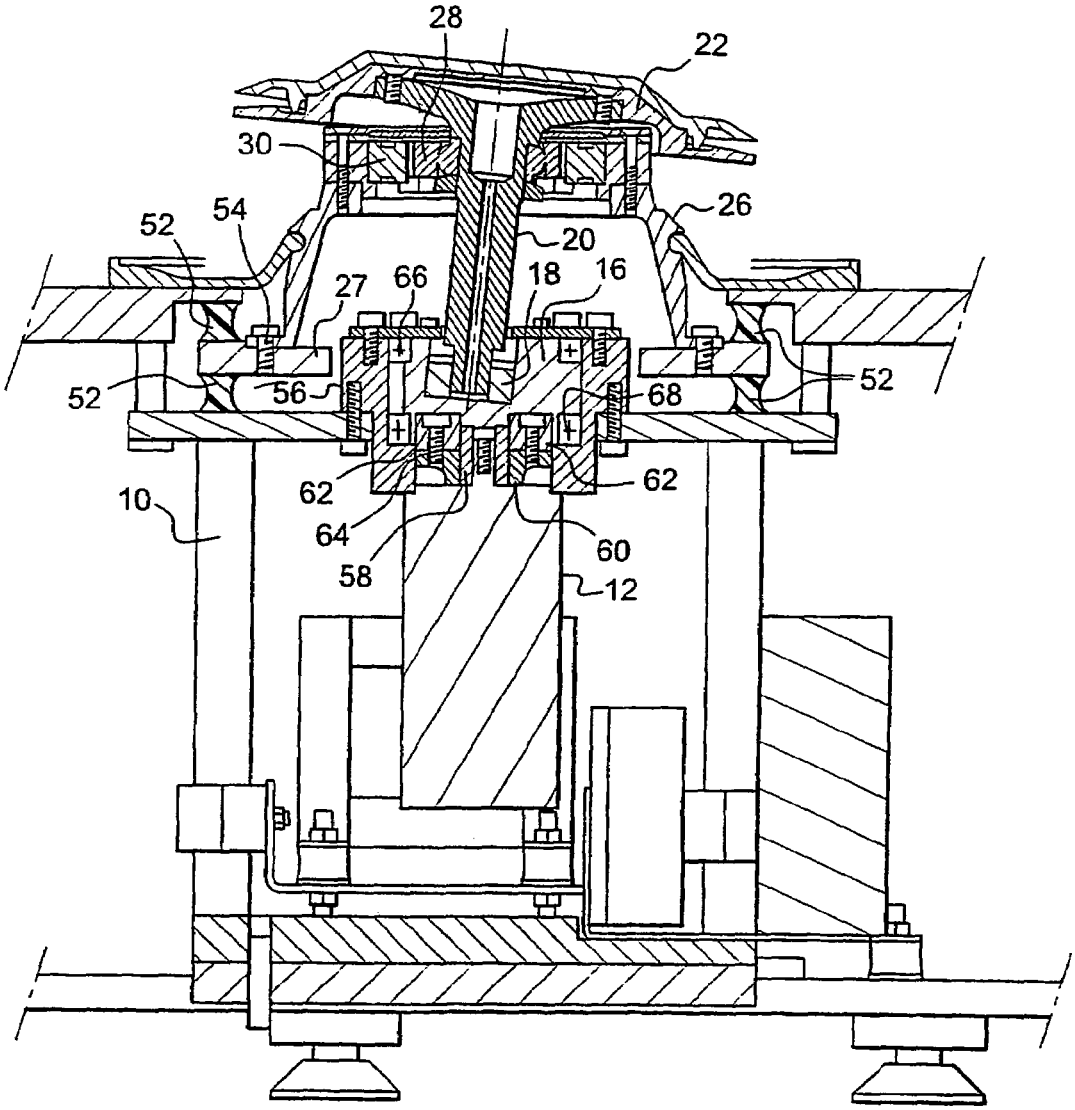
FIG. 6 is a fragmentary diagrammatic view showing another characteristic of the invention.

Another advantageous characteristic of the invention is shown in FIG. 6. In this figure, there can be seen the disk 22 mounted via the bearings 28 and 30 to the ring 26, itself mounted on the frame 10 via the plate 27 and the resilient suspension means 52.

The endpiece 20 of the disk 22 is mounted to slide axially at its bottom end in the eccentric bearing 18 carried by the turntable 16 as mentioned above.

The turntable 16 is not directly secured to the outer shaft of the motor 12, but it is mounted in a rolling-bearing box 56 secured to the frame 10 and rotated by the shaft of the motor 12 via a resilient coupling.

The resilient coupling comprises an expandable hub 58 for mounting a metal collar 60 on the outlet shaft of the motor 12, and rubber tubes 62 which are received in housings in the base of the turntable 16 and secured to the collar 60 by screws 64 housed in the tubes 62.

The rolling-bearing box 56 has a top horizontal rolling bearing 66 and a bottom horizontal rolling bearing 68, having their outer cages held stationary in the box 56. The inner cage of the top rolling bearing 66 is secured to the turntable 16 which can slide in the inner cage of the bottom rolling bearing 68 to accommodate thermal expansion.

This mount serves to protect the motor 12 even better against vibration and to decouple it from a vibratory point of view from the turntable 16, from the rolling bearing 18, and from the endpiece 20 of the disk 22. This increases the lifetime of the motor, and the apparatus of the invention can be used at full load and higher speeds of rotation (e.g. 6800 rpm or more instead of 6000 rpm) without any problems for the motor 12.

Finally, it should be observed that this apparatus advantageously includes a pivoting cap that is fitted over the disk 22 while the samples are being ground and that is fitted with means for locking it in the closed position, which means may be of the electromagnetic or of the suction type.

What is claimed is:

1. Apparatus for rapidly vibrating tubes containing samples, in particular biological samples, the apparatus comprising a disk for supporting the tubes, means for preventing the disk from turning about its own axis, and means for driving the disk in oscillating motion about a center of rotation situated on the axis of the disk, wherein the disk is supported and centered on an elastically-suspended portion of the apparatus by means of two concentric bearings mounted one within the other, one of the bearings being of the spherical type enabling the disk to execute oscillating motion about the center of rotation.

2. Apparatus according to claim 1, wherein said bearings are rolling bearings.

3. Apparatus according to claim 1, wherein a first of said bearings has a radially-inner cage constrained to rotate with an axial endpiece of the disk and a radially-outer cage constrained to rotate with a radially-inner cage of the second of said bearings, with its radially-outer cage being secured to the said stationary portion of the apparatus.

4. Apparatus according to claim 3, wherein the first bearing is a rolling bearing.

5. Apparatus according to claim 3, wherein the outer cage of the first bearing is constrained to move in rotation and in translation with the inner cage of the second bearing.

6. Apparatus according to claim 3, wherein the outer cage of the first bearing is movable in axial translation relative to the inner cage of the second bearing.

7. Apparatus according to claim 1, wherein the disk is prevented from turning about its axis by connection means connecting it to said suspended portion of the apparatus.

8. Apparatus according to claim 1, wherein the drive means comprise a third bearing that is eccentric and mounted at the end of a drive shaft, connecting said drive shaft to an axial endpiece of the disk.

9. Apparatus according to claim 8, wherein the endpiece of the disk is movable in axial translation in the third bearing.

10. Apparatus according to claim 1, wherein the concentric bearings of the disk are carried by a ring which is mounted on a stationary frame by resilient suspension means.

11. Apparatus according to claim 10, wherein the drive means of the disk comprise an electric motor mounted stationary relative to the frame.

12. Apparatus according to claim 11, wherein the endpiece of the disk is movable in axial translation in the third bearing, and wherein the eccentric third bearing is carried by a turntable which is mounted in a rolling-bearing box carried by the frame and which is connected to the drive shaft via a resilient coupling.

13. Apparatus according to claim 1, wherein the tubes carried by the disk are inclined towards the axis of the disk.

14. Apparatus according to claim 1, wherein the disk supports a circular ring having housings for receiving the tubes distributed in regular manner around the center of rotation of the disk, a cover for holding the tubes in their housings, means for holding the cover against the disk, and means for angularly positioning and locking the cover in its tube-holding position.

15. Apparatus according to claim 14, wherein the cover placed on the disk co- operates therewith to define a chamber that is closed in leaktight manner and that includes means for connection to a vacuum source.

16. Apparatus according to claim 15, wherein the means for connecting to the vacuum source forms means for preventing the disk from turning about its axis.

17. Apparatus according to claim 14, wherein the means for angularly positioning and locking the cover are resilient snap-fastening fingers.

18. Apparatus according to claim 14, wherein an annular strip of elastomer or the like is interposed between the cover and the tops of the tubes to close in leaktight manner the housings in the ring in which the tubes are received.

* * * * *